US006109518A

United States Patent [19]

Mueller et al.

[11] Patent Number: 6,109,518

[45] Date of Patent: Aug. 29, 2000

[54] HEATING-INSULATING CUP AND METHOD OF MAKING SAME

[75] Inventors: Berthold Mueller, Suessen; Gerhard Clauss, Donzdorf, both of Germany

[73] Assignee: Michael Hoerauf Maschinenfabrik GmbH & Co. KG, Donzdorf, Germany

[21] Appl. No.: 09/389,061

[22] Filed: Sep. 2, 1999

[30] Foreign Application Priority Data

Sep. 7, 1998 [DE] Germany ..... 198 40 841

[51] Int. Cl.[7] ..... B65D 3/22

[52] U.S. Cl. ..... 229/403; 229/4.5; 493/99; 493/100; 493/152; 493/157

[58] Field of Search ..... 229/4.5, 103.11, 229/400, 403; 220/62.18, 62.2; 493/95, 99, 100, 114, 152, 157, 379

[56] References Cited

U.S. PATENT DOCUMENTS

| | | | |
|---|---|---|---|
| 2,740,575 | 4/1956 | Fontaine | 229/400 |
| 2,828,903 | 4/1958 | Adkins | 229/403 |
| 5,145,107 | 9/1992 | Silver et al. | 229/403 |
| 5,460,323 | 10/1995 | Titus | 229/403 |
| 5,524,817 | 6/1996 | Meier et al. | 229/403 |
| 5,660,326 | 8/1997 | Varano et al. | 229/403 |
| 5,685,480 | 11/1997 | Choi . | |
| 5,752,653 | 5/1998 | Razzaghi | 229/403 |
| 5,904,264 | 5/1999 | Yamada et al. | 220/62.18 |

*Primary Examiner*—Gary E. Elkins
*Attorney, Agent, or Firm*—Evenson, McKeown, Edwards & Lenahan, P.L.L.C.

[57] ABSTRACT

A heat-insulating cup comprises an inner sleeve and an outer sleeve. The latter is supported against an upper and a lower area of the inner sleeve. An annular space is located between the inner sleeve and the outer sleeve, which annular space is free of any additional elements. A joint bottom is arranged to the inner sleeve and the outer sleeve. In the upper area, the inner sleeve has a sudden widening, on top of which the outer sleeve is disposed.

29 Claims, 3 Drawing Sheets

HEATING-INSULATING CUP AND METHOD OF MAKING SAME

BACKGROUND AND SUMMARY OF THE INVENTION

This application claims the priority of German application 198 40 841.2, filed in Germany on Sep. 7, 1998, the disclosure of which is expressly incorporated by reference herein.

The present invention relates to a heat-insulating cup having an inner and an outer sleeve, which is supported against an upper and a lower area of the inner sleeve, the outer sleeve otherwise surrounding an annular space, as well as comprising a joint bottom arranged at the inner sleeve and the outer sleeve.

A cup of this type is prior art in U.S. Pat. No. 5,685,480. The conical outer sleeve is somewhat folded inwards at its upper and lower end, so that it is supported at these two points on the also conical inner sleeve. The annular space between the inner sleeve and the outer sleeve is filled out with corrugated cardboard, which alternatively adheres to the inner sleeve and to the outer sleeve. This is to provide, in addition to the insulating effect, stability for the cup.

It is an object of the present invention to create a stable, heat-insulating cup, which is less complicated to produce.

This object has been achieved in accordance with the present invention in that the inner sleeve has a sudden widening in its upper area, on top of which widening the outer sleeve is disposed.

By means of this arrangement according to the present invention, the heat-insulating cup becomes sufficiently stable so that the annular space between the inner sleeve and the outer sleeve can advantageously remain free of any additional elements. As a result of the outer sleeve being supported on the widening of the inner sleeve, the conicity of the outer sleeve is as a rule more pointed than the conicity of the inner sleeve, and the annular space also becomes wider in the upper area of the cup. In this way, the stability of the inner sleeve with its contents cannot be impaired, even when the outer sleeve is pressed inwards when the cup is held. An important advantage thereof is that a heat-insulating cup of this kind can be produced very easily.

The widening in the upper area of the inner sleeve is as large as is achievable in the case of cardboard. The widening lies in the range of maximum 1 mm.

In an embodiment of the present invention it is provided that the outer sleeve with its lower end is folded around the lower end of the inner sleeve and also around a rim of the bottom. This permits an optically better finish towards the bottom.

The supporting of the outer sleeve on the inner sleeve in the lower area can take place directly or indirectly. Advantageously, a small intermediary layer is formed in the lower area of the inner sleeve, which intermediary layer ensures a minimum distance between the outer sleeve and the inner sleeve in the area of the bottom. For example, in one embodiment of the present invention, the lower end of the inner sleeve in the area of the bottom can be folded outwards, so that the wall thickness of the inner sleeve ensures the desired distance. In the case of another embodiment of the present invention, the bottom can be rolled outwards around the lower end of the inner sleeve, so that the thickness of the bottom ensures the desired distance between the inner sleeve and the outer sleeve. In any case, the outer sleeve is supported against the inner sleeve in the lower area of the cup by means of the above mentioned intermediary layer. In the upper area of the cup, however, the outer sleeve is disposed directly on the widening of the inner sleeve.

The upper area of the cup can have various designs. In one embodiment according to the present invention, the upper ends of the inner sleeve and the outer sleeve are rolled in together, for example to a round or flat pressed lip. In another embodiment of the present invention, the upper end of the unrolled outer sleeve is clamped in the rolled up upper end of the inner sleeve.

At the affixing points between the outer and inner sleeve or between the outer sleeve and the bottom, a sealing or a pressing can be provided. Alternatively, adhering by means of a glue application is also possible.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
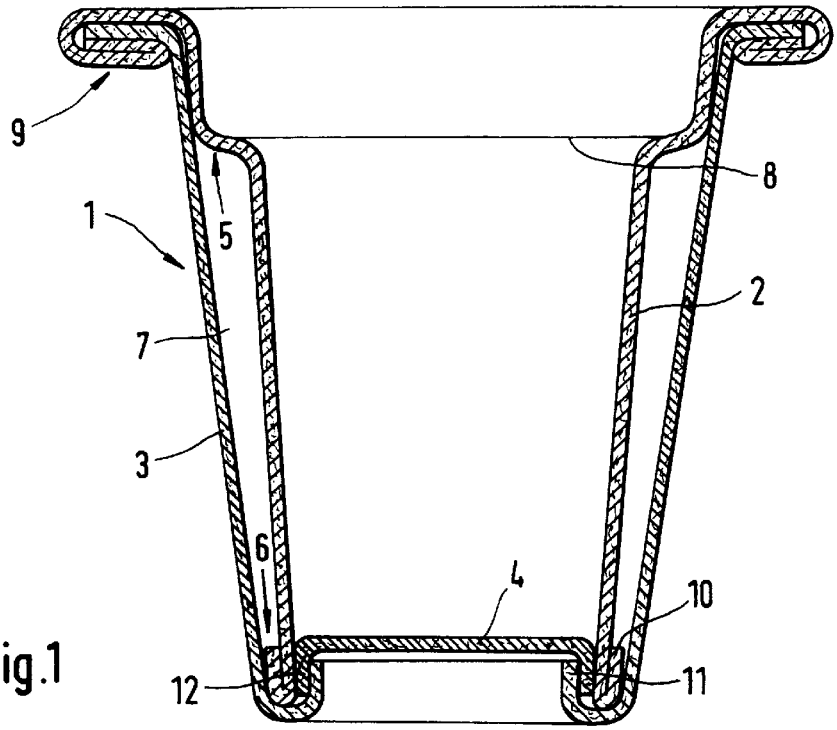
FIG. 1 is a longitudinal sectional view showing a first embodiment of a heat-insulating cup according to the present invention.

The heat-insulating cup 1 according to FIG. 1 comprises an inner sleeve 2 and an outer sleeve 3, each made of paper or cardboard. The outer sleeve 3 is supported against an upper area 5 and a lower area 6 of the inner sleeve 2. A joint bottom 4 is arranged for the inner sleeve 2 and the outer sleeve 3.

Between the conical inner sleeve 2 and the more strongly conical outer sleeve 3 there is an annular space 7, which widens in its upper area and which is free from any additional elements. The upper part of the annular space 7 is defined by a sudden widening 8 of the inner sleeve 2. The outer sleeve 3 is disposed against the 1 mm wide shoulder arising therefrom.

When the cup 1 is filled with a hot filling content, the outer sleeve 3 remains sufficiently cold due to the insulating annular space 7 so that the outer sleeve 3 can be held by a person. In reverse, cooled filling contents in the cup 1 remains sufficiently cold, even when the outer sleeve 3 is subjected to a warmer atmosphere. Due to the support at the widening 8, the cup 1 is sufficiently stable, and a slight pressing inwards of the outer sleeve 3 does not in any way impair the inner sleeve 2 containing the filling contents.

In the upper area 5, the inner sleeve 2 and the outer sleeve 3 are rolled in together to form a flat pressed lip 9. The embodiments according to the present invention described below demonstrate variations which differ from each other in this area.

In the area of the bottom 4, the lower end 10 of the inner sleeve 2 is folded outwards, so that the outer sleeve 3 can be supported in the lower area 6 on this lower end 10. Thus, at this narrowest point of the annular space 7 also, a sufficiently large distance arises between the inner sleeve 2 and the outer sleeve 3. The lower end 11 of the outer sleeve 3 is folded around the lower end 10 of the inner sleeve 2 as well as around a rim 12 of the bottom 4, to give an optically better finish.

In a way not shown, the cup 1 can be closed after it has been filled with filling contents by means of a covering foil or another type of lid.

Figure 2:
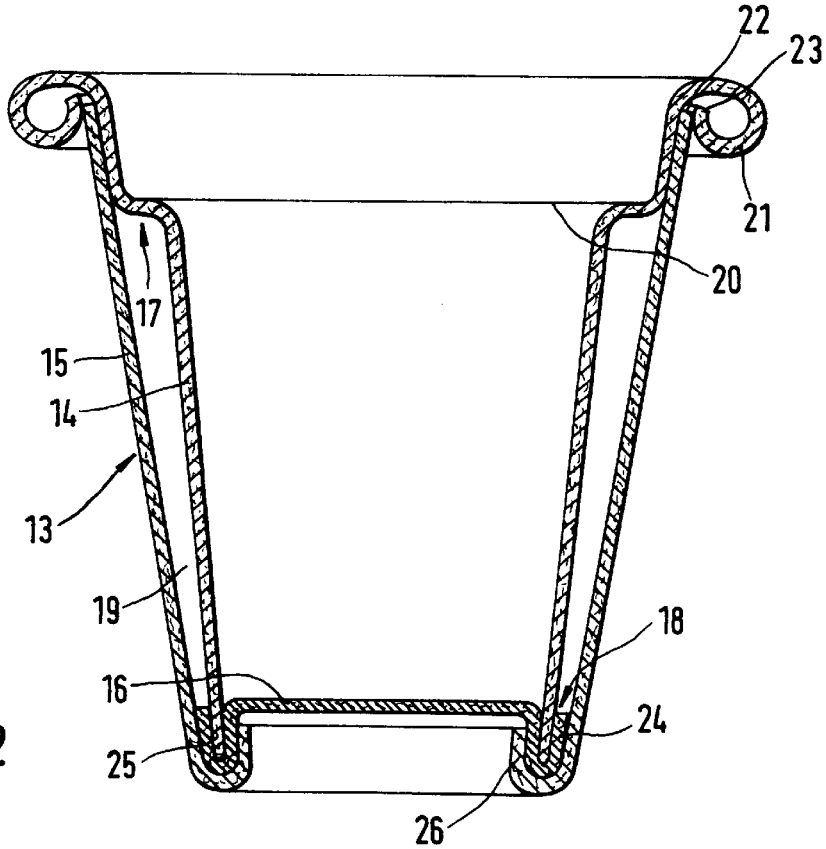
FIG. 2 is a longitudinal sectional view showing a second embodiment of a heat-insulating cup according to the present invention.

The heat-insulating cup 13 according to FIG. 2 is designed somewhat differently and comprises also a conical inner sleeve 14 and a conical outer sleeve 15. The outer sleeve 15 is supported against the inner sleeve 14 in an upper area 17 and in a lower area 18. Between the inner sleeve 14 and the outer sleeve 15, an annular space 19 is located, which widens upwards. This annular space 19 is also free from any additional elements.

The cup 13 comprises in the upper area 17 of the inner sleeve 14 a sudden widening 20 having a shoulder of approximately 1 mm. At the point of the widening 20, the outer sleeve 15 is disposed directly on the inner sleeve 14. This design ensures a good stability on the one hand, and on the other a sufficiently effective insulation.

In the embodiment of the present invention according to FIG. 2, only the inner sleeve 14 is rolled in to form a round lip 21. The upper end 22 of the outer sleeve 15 in contrast is unrolled and clamped in the upper end 23 of the inner sleeve 14 or the lip 21. Clamping can be supported by sealing or adhering.

Differing from the embodiment according to FIG. 1, the variation in FIG. 2 shows that the rim 24 of the bottom 16 is rolled outwards around the lower end 25 of the inner sleeve 14. The rim 24 thus effects the necessary distance between the inner sleeve 14 and the outer sleeve 15 in the lower area 18. The lower end 26 of the outer sleeve 15 is folded around the lower end 25 of the inner sleeve 14 as well as around the rolled-in rim 24 of the bottom 16.

The cup 13 can also be closed by means of a covering foil or by another type of lid.

The production process of the cup 1 according to FIG. 1 is described in more detail below with the aid of the FIGS. 3 to 9, while FIGS. 10 to 15 illustrate the production process of the cup 13 according to FIG. 2.

Figure 3:
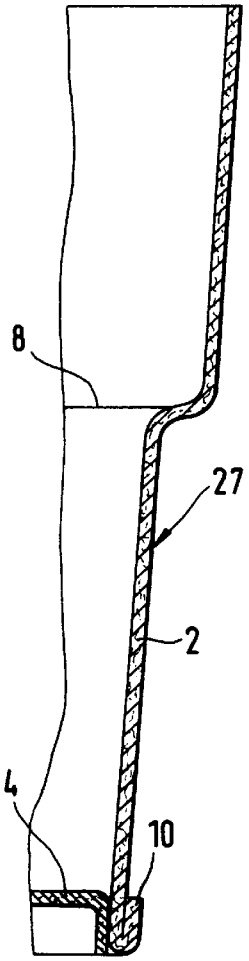
FIGS. 3 to 9 schematically depict the individual process stages in producing a cup according to FIG. 1.

According to FIG. 3, an intermediary cup 27 is produced, which has as yet no lip. The lower end 10 of the inner sleeve 2 is folded outwards at the bottom 4. In addition, there is in the subsequent upper area 5 the widening 8 mentioned above of the cup 1 to be produced.

According to FIG. 4, an outer sleeve 3 formed aw a tube is placed over the intermediary cup 27 from below, whereby the lower end 11 of the outer sleeve 3 is folded over the bottom end 10 of the inner sleeve 2 as well as over the rim 12 of the bottom 4. The lower end 11 of the outer sleeve 3 can either be pressed and/or sealed. Alternatively, an application of an adhesive substance can also be utilized.

Figure 4:
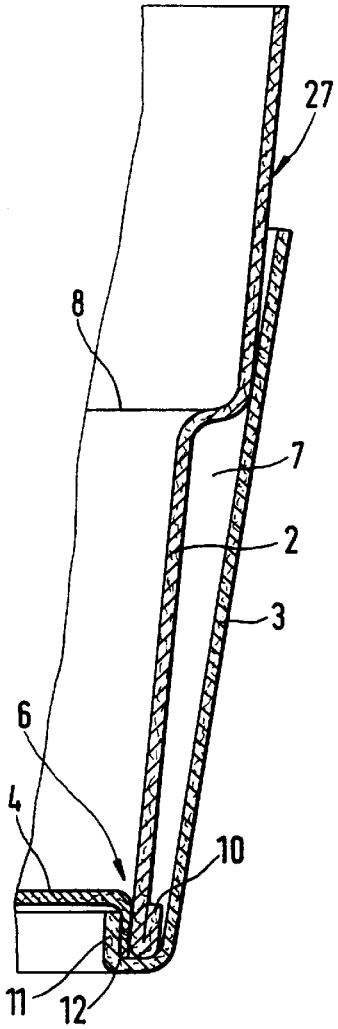
Figure 5:
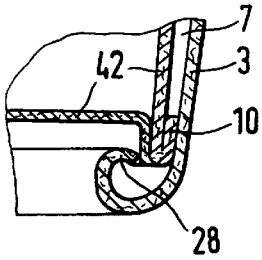

FIG. 5 shows a variation of the FIG. 4 arrangement, according to which the lower end 28 of the outer sleeve 3 is only rolled inwards.

Figure 6:
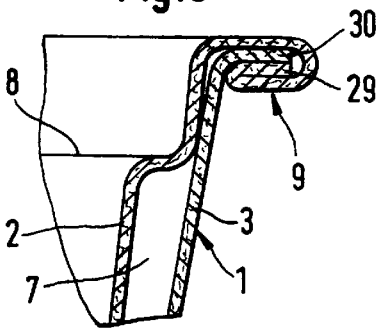

In a/subsequent procedural step according to FIG. 6 the flat pressed lip 9 is formed, as already shown and described with the aid of FIG. 1. The inner sleeve 2 and the outer sleeve 3 are rolled up together and pressed flat. The upper end 29 of the inner sleeve 2 and the upper end 30 of the outer sleeve 3 are all located in the inside of the flat pressed lip 9.

Figure 7:
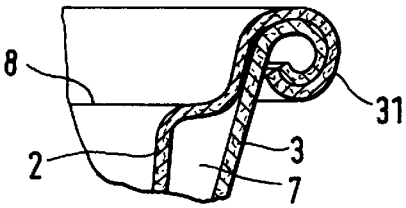

FIG. 7 shows a variation to FIG. 6, in which the inner sleeve 2 and the outer sleeve 3 are both rolled inwards to form a round lip 31.

Figure 8:
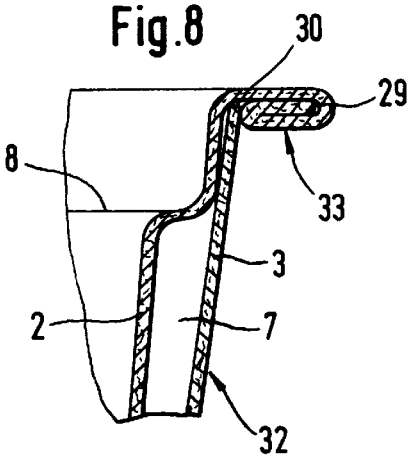

FIG. 8 shows a variation of FIG. 1, in which an insulating cup 32 is produced, which differs from the cup of FIG. 1 only in the upper area. In this case, only the upper end 29 of the inner sleeve 2 is rolled up to form a flat lip 33. The outer sleeve 3 is unrolled and only clamped in. This can be supported by means of sealing or adhering.

Figure 9:
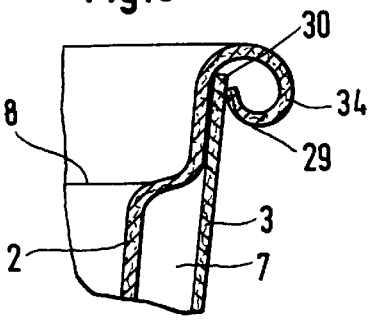

FIG. 9 shows a variation of FIG. 8, in which the outer sleeve 3 is again unrolled and this time is clamped into a round lip 34 of the inner sleeve 2.

Figure 10:
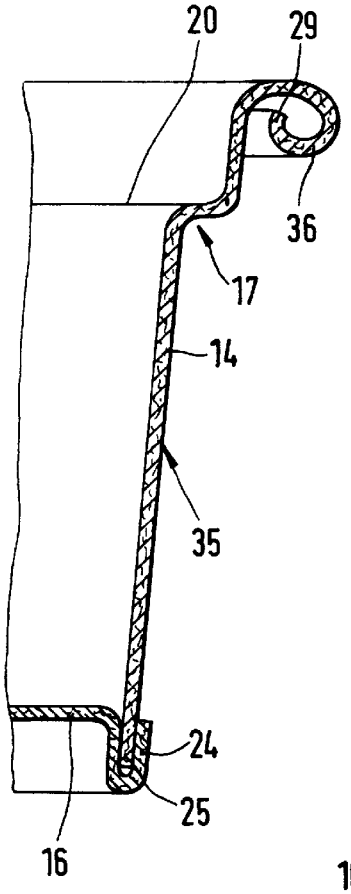
FIGS. 10 to 15 schematically depict the individual process stages in producing a cup according to FIG. 2.

According to FIG. 10, an intermediary cup 35 is first produced for the cup 13 shown in FIG. 2. The inner sleeve 14 comprises the widening 20 according to the invention in the upper area 17 and is further already provided with a lip 36. The bottom 16 is rolled outwards with a rim 24 around the lower end 25 of the inner sleeve 14 and is either pressed or sealed.

Figure 11:
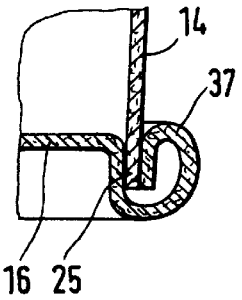

FIG. 11 is a variation of FIG. 10, whereby the bottom 16 is rolled around the lower end 25 of the inner sleeve 14 to form a very distinctive lip 37. Thus the distance between the inner sleeve 14 and the outer sleeve 15 applied later is enlarged.

Figure 12:
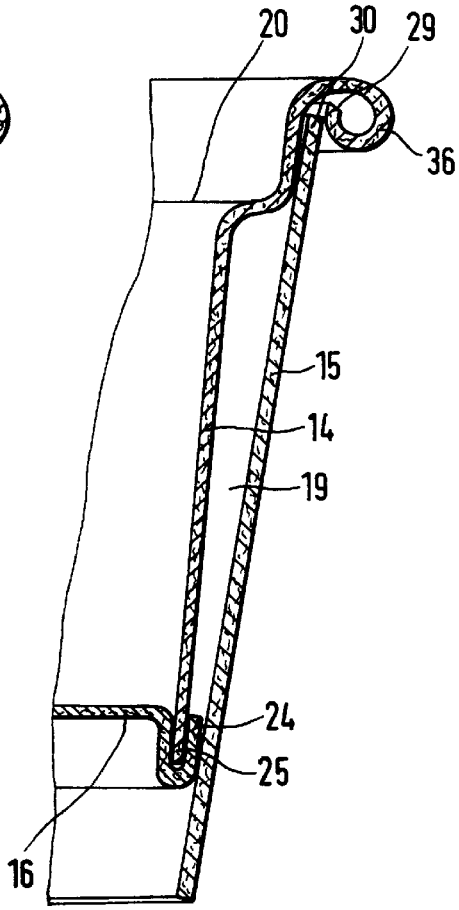

FIG. 12 shows the next procedural step for the production of the cup 13. The outer sleeve 15 formed as a tube is placed from below onto the intermediary cup 35 and clamped in the lip 36.

Figure 13:
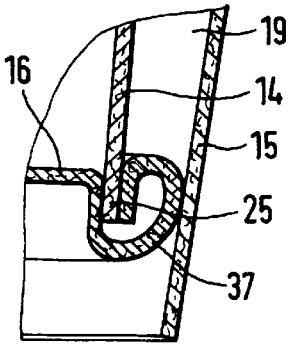

Shown here also in FIG. 13 is the way the lip 37 of FIG. 11 can be disposed on the outer sleeve 15.

Figure 14:
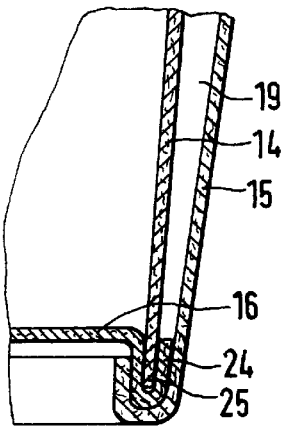

FIG. 14 shows the next procedural step, whereby the outer sleeve 15 is rolled around the rim 24 of the bottom 16 and around the lower end 25 of the inner sleeve 14 and pressed or sealed. An application of an adhesive substance is also contemplated according to certain preferred embodiments of the invention.

Figure 15:
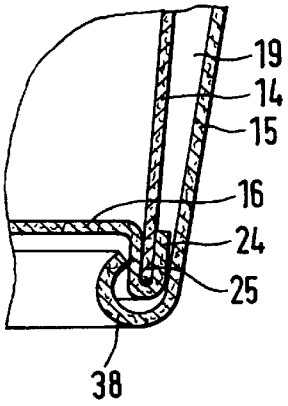

FIG. 15 is a variation of FIG. 14, whereby the outer sleeve 15, as a distinctive lip 38, is rolled around the rim 24 of the bottom 16 and around the lower end 25 of the inner sleeve 14.

In all the embodiments of the cup 1 according to FIG. 1 and of the cup 13 according to FIG. 2, when sealing or pressing is not used, affixing of both of the outer sleeves 3 or 15 can be achieved by means of adhering.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A heat-insulating cup comprising:

an inner sleeve, an outer sleeve, the outer sleeve being supported against an upper and a lower area of the inner sleeve, the outer sleeve otherwise surrounding an annular space around the inner sleeve, and a joint bottom arranged at the inner sleeve and the outer sleeve, wherein the inner sleeve has a sudden widening in the upper area, on which widening the outer sleeve is disposed.

2. A heat-insulating cup according to claim 1, wherein the outer sleeve with its lower end is rolled around the lower end of the inner sleeve as well as around a rim of the bottom.

3. A heat-insulating cup according to claim 2, wherein the lower end of the inner sleeve is folded over towards the outside in the area of the bottom.

4. A heat-insulating cup according to claim 2, wherein the bottom is rolled outwards around the outer end of the inner sleeve.

5. A heat-insulating cup according to claim 1, wherein upper ends of the inner sleeve and the outer sleeve are rolled up together.

6. A heat-insulating cup according to claim 2, wherein the upper ends of the inner sleeve and the outer sleeve are rolled up together.

7. A heat-insulating cup according to claim 3, wherein the upper ends of the inner sleeve and the outer sleeve are rolled up together.

8. A heat-insulating cup according to claim 4, wherein the upper ends of the inner sleeve and the outer sleeve are rolled up together.

9. A heat-insulating cup according to claim 1, wherein the upper end of the outer sleeve is clamped in an unrolled state into the rolled up upper end of the inner sleeve.

10. A heat-insulating cup according to claim 2, wherein the upper end of the outer sleeve is clamped in an unrolled state into the rolled up upper end of the inner sleeve.

11. A heat-insulating cup according to claim 3, wherein the upper end of the outer sleeve is clamped in an unrolled state into the rolled up upper end of the inner sleeve.

12. A heat-insulating cup according to claim 4, wherein the upper end of the outer sleeve is clamped in an unrolled state into the rolled up upper end of the inner sleeve.

13. A heat-insulating cup according to claim 1, wherein the annular space between the inner sleeve and the outer sleeve is free from any additional elements.

14. A heat-insulating cup according to claim 2, wherein the annular space between the inner sleeve and the outer sleeve is free from any additional elements.

15. A heat-insulating cup according to claim 3, wherein the annular space between the inner sleeve and the outer sleeve is free from any additional elements.

16. A heat-insulating cup according to claim 4, wherein the annular space between the inner sleeve and the outer sleeve is free from any additional elements.

17. A heat-insulating cup according to claim 5, wherein the annular space between the inner sleeve and the outer sleeve is free from any additional elements.

18. A heat-insulating cup according to claim 6, wherein the annular space between the inner sleeve and the outer sleeve is free from any additional elements.

19. A heat-insulating cup according to claim 1, wherein said inner and outer sleeves are made of cardboard.

20. A method of making a heat-insulating cup, comprising:

forming an inner tubular sleeve with outwardly tapering side walls extending from bottom end toward a top end, said top end including an outwardly protruding widening area, forming an outer tubular sleeve with outwardly tapering side walls extending from a bottom end toward a top end, applying said outer tubular sleeve by moving same upwardly around the inner sleeve, connecting a joint bottom to the inner and outer tubular sleeves, and connecting the top end of the inner sleeve to the top end of the outer sleeve along a portion of said widening area, thereby creating an annular insulating space below the widening area between the inner and outer sleeves.

21. A method according to claim 20, wherein said inner and outer sleeve are made of cardboard.

22. A method according to claim 20, wherein the outer sleeve with its lower end is rolled around the lower end of the inner sleeve as well as around a rim of the bottom.

23. A method according to claim 22, wherein the lower end in of the inner sleeve is folded over towards the outside in the area of the bottom.

24. A method according to claim 22, wherein the bottom is rolled outwards around the outer end of the inner sleeve.

25. A method according to claim 20, wherein upper ends of the inner sleeve and the outer sleeve are rolled up together.

26. A method according to claim 22, wherein upper ends of the inner sleeve and the outer sleeve are rolled up together.

27. A method according to claim 20, wherein the upper end of the outer sleeve is clamped in an unrolled state into the rolled up upper end of the inner sleeve.

28. A method according to claim 20, wherein the annular space between the inner sleeve and the outer sleeve is free from any additional elements.

29. A method according to claim 20, wherein said bottom is made of cardboard.

* * * * *